US005782706A

United States Patent [19]

DePriest

[11] Patent Number: 5,782,706

[45] Date of Patent: Jul. 21, 1998

[54] GOLF PUTTER, COMPONENTS THEREOF AND METHODS OF MAKING THE SAME

[76] Inventor: Dennis K. DePriest, 4948 N. Pine Hill Dr., Ozark, Mo. 65721

[21] Appl. No.: 880,841

[22] Filed: Jun. 23, 1997

[51] Int. Cl.[6] ..... A63B 53/04

[52] U.S. Cl. ..... 473/341; 473/313; 473/336

[58] Field of Search ..... 473/304, 305, 473/313, 314, 334, 335, 336, 337, 338, 339, 340, 341, 342, 345, 346, 347, 349, 350

[56] References Cited

U.S. PATENT DOCUMENTS

| | | | |
|---|---|---|---|
| 1,902,660 | 3/1933 | Nelson | 473/336 |
| 3,843,122 | 10/1974 | Florian . | |
| 3,873,094 | 3/1975 | Sebo et al. | 473/340 |
| 4,712,798 | 12/1987 | Preato . | |
| 4,824,115 | 4/1989 | Walther | 473/341 |
| 4,834,387 | 5/1989 | Waites et al. . | |
| 4,872,684 | 10/1989 | Dippel . | |
| 4,991,843 | 2/1991 | Mori . | |
| 5,082,277 | 1/1992 | Gingold . | |
| 5,375,840 | 12/1994 | Hirsch et al. . | |
| 5,447,310 | 9/1995 | Jernigan | 473/341 |
| 5,482,281 | 1/1996 | Anderson . | |
| 5,501,461 | 3/1996 | Donofrio | 473/341 |
| 5,533,725 | 7/1996 | Reynolds, Jr. . | |
| 5,676,606 | 10/1997 | Schaeffer et al. | 473/340 |

*Primary Examiner*—Steven B. Wong
*Attorney, Agent, or Firm*—Richard L. Marsh

[57] ABSTRACT

A golf putter having a shaft with a grip at one end and a head at the opposite end, the head having a heel end, a toe end spaced longitudinally from the heel end, a top surface, a rear surface, a bottom surface and a substantially planar front face, the head comprising an open molded compounded thermosetting polymeric resin composite enclosing a weighted mass. The weighted mass has an aperture in the mass extending from the heel end to a central portion with a portion lying parallel to and spaced from a front edge of the mass for receiving the terminal end of the putter shaft. The weighted mass has needle like projections on its bottom surface suspending the mass above the bottom surface of the head. The mass may be "g" shaped with the tail of the "g" lying in the toe end of the head and the leg lying parallel to the planar front face. The shaft is glued to head.

20 Claims, 3 Drawing Sheets

FIG. 3
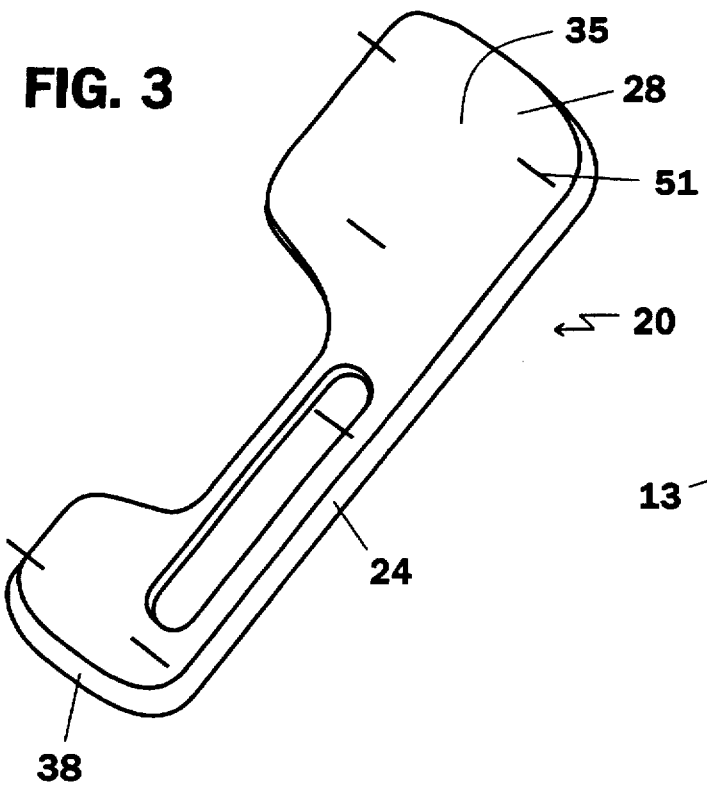
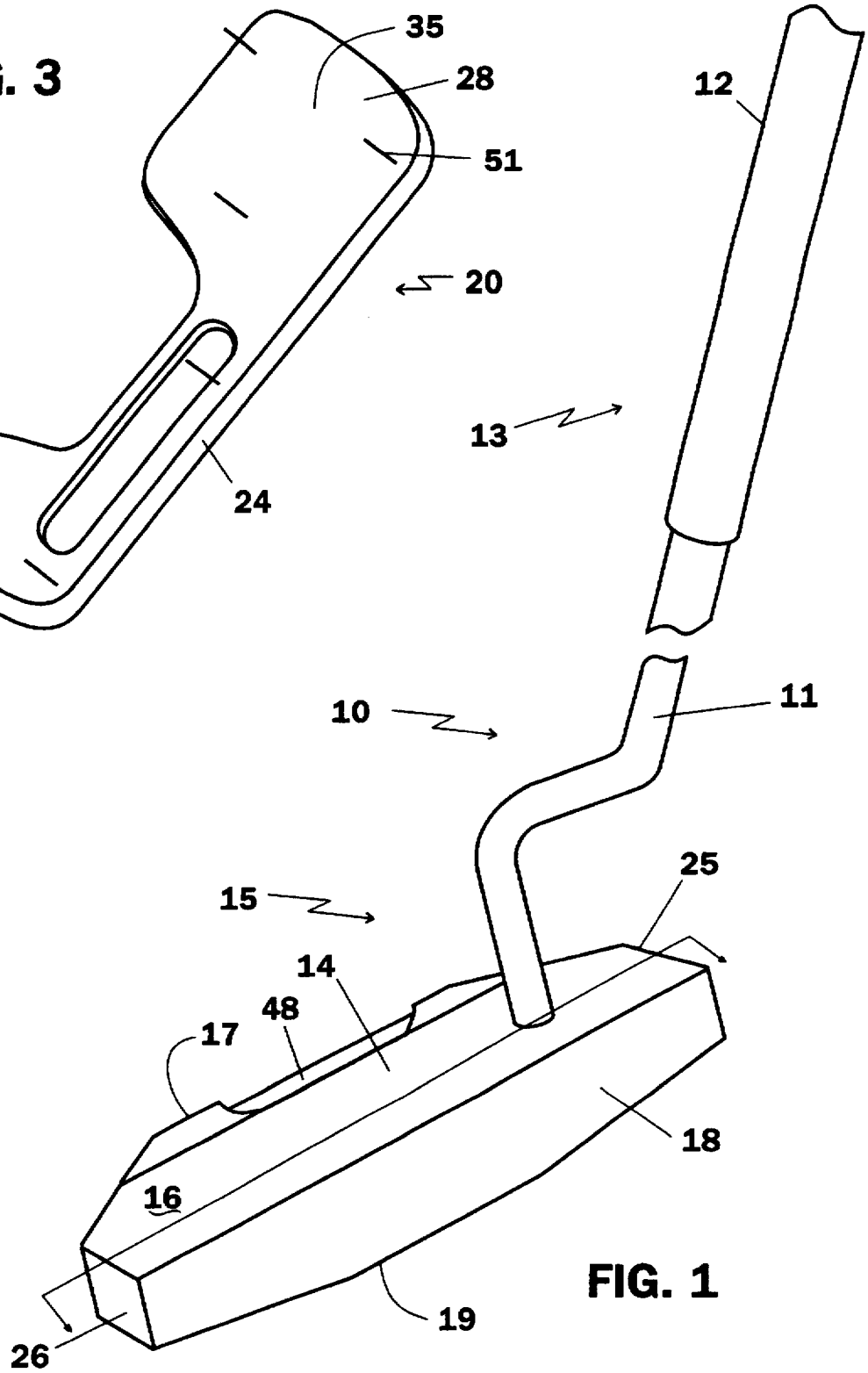
FIG. 1

FIG. 4
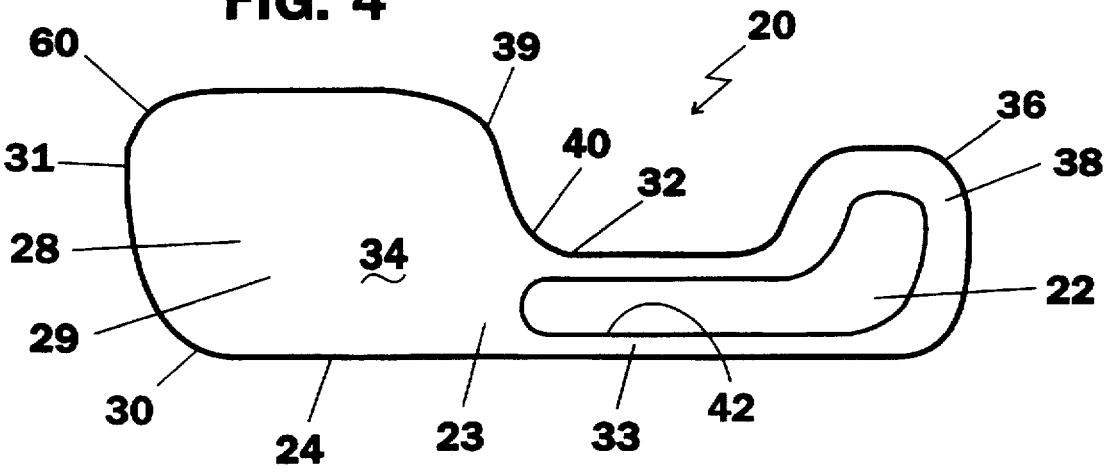
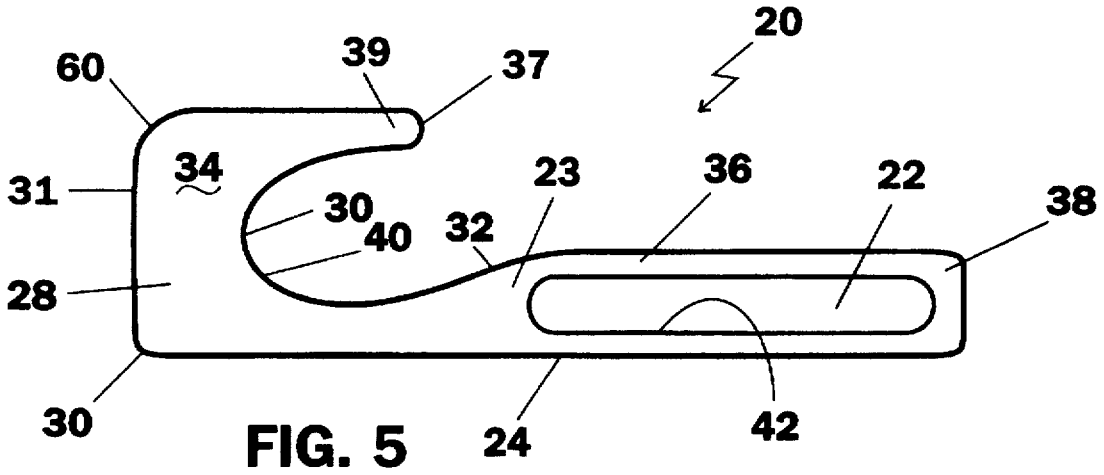
FIG. 5
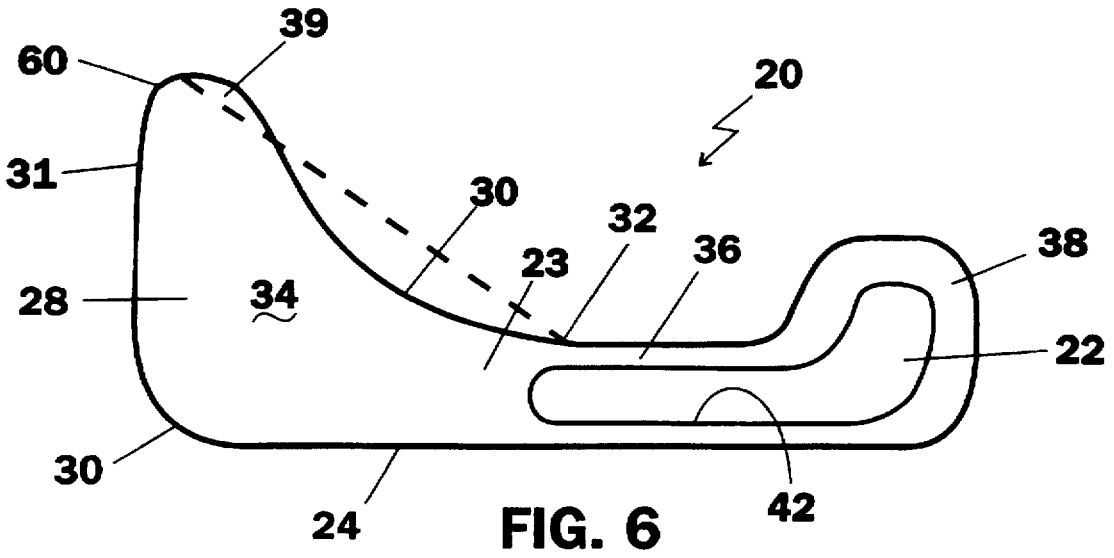
FIG. 6

GOLF PUTTER, COMPONENTS THEREOF AND METHODS OF MAKING THE SAME

BACKGROUND OF THE INVENTION

1. Field of the Invention

This invention relates to a golf putter and more particularly to a putter having a weighted mass fully enclosed within an open molded compounded thermosetting polymeric resin composite.

2. Prior Art Statement

It is known to provide a golf putter having removable weights which can be selectively exchanged with cooperatively formed weights to adjust the overall weight of the club. For instance, see the U.S. Pat. No. 5,533,725 issued on Jul. 9, 1996 to Walker Reynolds, Jr.

It is known to provide a golf putter having a polycarbonate club head with adjustable weighting means for varying the overall weight of the club. For instance, see the U.S. Pat. No. 4,712,798 issued on Dec. 15, 1987 to Mario Preato.

It is also known to provide a golf putter having an plastic acetal resin main body with a first weight receiving receptacle in the heel end, a second weight receiving receptacle in the toe end and weights in each of the receptacles having a higher weight per volume ratio than the plastic body adjustable weighting means for varying the overall weight of the club. For instance, see the U.S. Pat. No. 4,872,684 issued on Oct. 10, 1989 to Stephanie A. Dippel.

It is known to provide a golf putter having a putter head comprising a lower base plate member of heavy-weight material with heel and toe weights attached thereto and an upper shell-like member of lightweight material enclosing the heel and toe weights. For instance, see the U.S. Pat. No. 5,482,281 issued on Jan. 9, 1996 to Douglas W. Anderson.

It is known to provide a golf putter having a putter head comprising an upper lightweight block and a lower base plate member of denser material secured to the upper block and a weight means in the head such that the distribution of weight in the geometric toe half of the head is significantly greater than the weight in the geometric heel half. For instance, see the U.S. Pat. No. 4,834,387 issued on May 30, 1989 to Waites, et al.

Additionally, it is known to provide a golf club having a head comprising a metal core and an outer member of plastic or fiber reinforced plastic. For instance, see the U.S. Pat. No. 4,991,843 issued on Feb. 12, 1991 to Masahiro Mori.

It is further known to provide a set of golf club irons having a concentration of mass within the head substantially adjacent the intersection of the heel and the top edge in the longest iron and being further disposed toward the sole and toe sequentially in each club progressing to the shortest iron thereof. For instance, see the U.S. Pat. No. 5,375,840 issued on Dec. 27, 1994 to Hirsch, et al.

It is also known to provide a golf putter having a putter head comprising a core structure including a sleeve of rectangular cross section having a block of light density contained between inserts of greater density than the block all disposed within the sleeve and a plastic shell formed substantially entirely about the core structure. For instance, see the U.S. Pat. No. 3,843,122 issued on Oct. 22, 1974 to Raymond J. Florian.

Finally, it is known to provide a golf putter having a polycarbonate putter head having means for weighting such that the overall head weight is generally light wherein the weighting means is embodied within the head and has a second weighted member behind the first member adjacent and to one side of the centerline of the head. For instance, see the U.S. Pat. No. 5,082,277 issued on Jan. 21, 1992 to Allen Gingold.

SUMMARY OF THE INVENTION

Each of the above patents provides an advance in the state of the art but none provide the "feel" of a putter comprising a open molded compounded thermosetting polymeric resin composite having a weighted mass fully enclosed therein.

Therefore, it is an object of this invention to provide a golf putter having a shaft with a grip at one end and a head at the opposite end, the head having a heel end, a toe end spaced longitudinally from the heel end, a top surface, a rear surface, a bottom surface and a substantially planar front striking face, the head comprising a open molded compounded thermosetting polymeric resin composite having a weighted mass fully enclosed therein and wherein the terminal end of the shaft resides in an aperture in the mass with the shaft fixedly attached to the head.

It is an object of this invention to provide a putter wherein the head has a preponderance of a weighted mass at the toe end thereof.

It is an object of this invention to provide a putter wherein the head has a preponderance of a weighted mass at the toe end thereof and has the shaft affixed to the heel end.

It is another object of this invention to provide a putter wherein the head has a preponderance of a weighted mass at the toe end thereof and has the shaft centrally affixed to the head.

It is yet another object of this invention to provide a putter having the head with a weighted mass at the toe end thereof wherein the weighted mass has needle like projections extending to the bottom surface of the thermoset polymeric head supporting the weighted mass above the bottom surface.

It is an object of this invention to provide a putter wherein the head is an open molded thermoset polymeric resin composite compounded from a resin selected from the group comprising epoxy, acrylic, vinyl ester, methyl methacrylate, isophthalic polyester, terephthalic polyester, orthophthalic polyester, dicyclopentadiene and urethane.

It is an object of this invention to provide a putter wherein the head is an open molded thermoset polymeric resin having ground walnut shells incorporated therein approximating a wood particle, stone or bone like look to the head.

It is still another object of this invention to provide a golf putter having a shaft with a grip at one end and a head at the opposite end, the head having a heel end, a toe end spaced longitudinally from the heel end, a top surface, a rear surface, a bottom surface and a substantially planar front face, the head comprising a open molded compounded thermosetting polymeric resin composite having a weighted mass fullly enclosed therein, the weighted mass having an aperture therein extending from the heel end to a central portion between the heel end and the toe end and parallel to and spaced from a front edge of the weighted mass, the aperture receiving the terminal end of the shaft therein, and wherein the shaft is fixedly attached to the head.

It is yet another object of this invention to provide a putter having the weighted mass located above the base no more than one half of the diameter of the ball to be struck.

It is still another object of this invention to provide a putter having the weighted mass captured in a thermoset polymeric head at approximately three eighths inch (⅜") above the bottom surface.

Yet another object of this invention is to provide a golf putter having a shaft with a grip at one end and a head at the opposite end, the head having a heel end, a toe end spaced longitudinally from the heel end, a top surface, a rear surface, a bottom surface and a substantially planar front face, the head comprising a open molded compounded thermoset resin composite enclosing a "g" shaped weighted mass therein, the weighted mass having an aperture for receiving the terminal end of the shaft therein and wherein the shaft is fixedly attached to the head.

It is yet another object of this invention to provide a putter having a "g" shaped weighted mass lying therein with the tail of the "g" in the toe end and containing a preponderance of the weighted mass in the toe end.

It is another object of this invention to provide a putter having an aperture in a "g" shaped weighted mass extending from the heel end to a central portion between the heel end and the toe end, a portion of the aperture lying parallel to and spaced from a front edge of the weighted mass.

It is yet another object of this invention to provide a putter wherein the weighted mass has its vertical center of gravity at or below the centerline of the ball to be struck.

BRIEF DESCRIPTION OF THE DRAWINGS

FIG. 1 is a perspective view of the preferred embodiment of a blade type golf putter of this invention.

FIG. 3 is a bottom perspective view of the weighted mass showing spikes attached thereto to support the mass in the mold above the bottom surface of the club head.

FIG. 4 is a top plan view of the preferred weighted mass.

FIG. 5 is a top plan view of an alternative weighted mass.

FIG. 6 is a top plan view of another weighted mass.

DESCRIPTION OF THE PREFERRED EMBODIMENTS

While the various features of this invention are hereinafter described and illustrated as a golf club having a head comprising a open molded compounded thermosetting polymeric resin composite with a weighted mass fully enclosed therein and having the terminal end of the club shaft residing in an aperture in the mass it is to be understood and is readily apparent that the invention can be used for any or all golf clubs.

Figure 2:
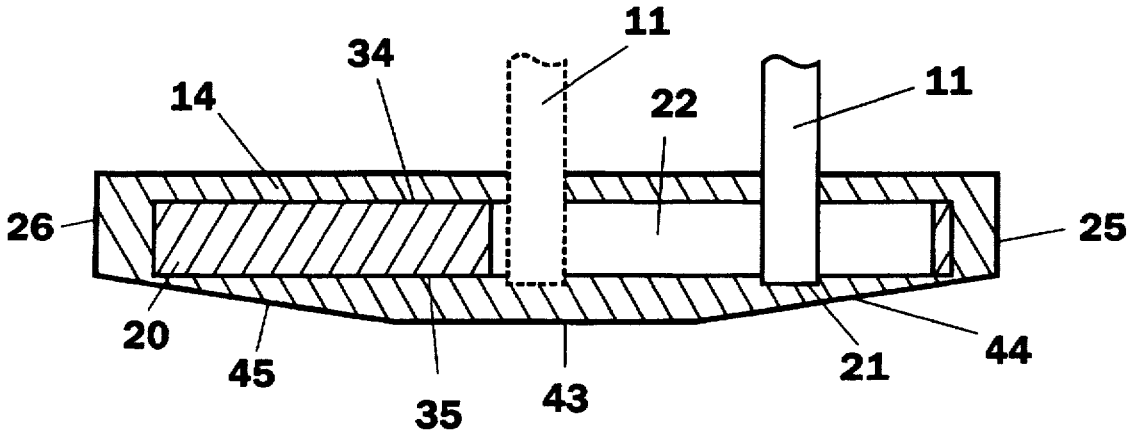
FIG. 2 is a section view in the direction of line 2—2 of FIG. 1 showing the location of a weighted mass enclosed in the putter head.

Referring now to FIG. 1, a golf putter 10 having a shaft 11 with a grip 12 at one end 13 and a head 14 at the opposite end 15 is shown. Head 14 has a heel end 25, a toe end 26 spaced longitudinally from heel 25, a top surface 16, a rear surface 17, a substantially planar front striking face 18 and a bottom surface 19, head 14 comprising a open molded compounded thermosetting polymeric resin composite enclosing a weighted mass 20 therein. As best shown in FIG. 2, the terminal end of shaft 11 resides in an aperture 22 in mass 20 and is fixedly attached to head 14 as will hereinafter be described.

Referring now to FIG. 1 and FIGS. 4–6, head 14 has a preponderance of weighted mass 20 disposed at toe end 26 in an enlarged portion 28. Weighted mass 20 has aperture 22 passing completely therethrough and generally extending from a reduced portion 38 through a leg 33 in central portion 23 of head 14. Aperture 22 preferably has a first portion 42 generally parallel to and spaced from a front edge 24 of weighted mass 20. Aperture 22 is adapted to receive terminal end at any location along the length thereof but is preferably affixed to heel end 25. Individual golfers however, may prefer shaft 11 to be affixed in central portion 23 according to the particular stance and ball address of the individual golfer or at any location between heel end 25 and central portion 23 as stated above. It will become readily apparent that the "feel" of putter 10 of this invention will be largely unaffected by the location of the shaft as weighted mass 20 enlarges the "sweet spot" of striking face 18 at least to the effective length of weighted mass 20 by placing a preponderance of the mass of weighted mass 20 at toe end 26.

The particular shape of weighted mass 20 selected to be enclosed and encapsulated by the particular shape of head 14 may assume dimensions relative to head 14 while retaining the feature of a concentration of mass at toe end 26. As best shown in FIG. 2, weighted mass 20 is a flat plate having parallel and flat upper surface 34 and lower surface 35 formed in the desired shape for the putter head 14 to be constructed. For use in a head 14 in the preferred embodiment of a blade type putter 10 of FIG. 1, weighted mass 20 may be generally "g" shaped as shown in FIG. 4, hook shaped as shown in FIG. 5 or hatchet shaped as in FIG. 6. All these embodiments of weighted mass 20 have a reduced portion 38 placed in heel end 25, a larger portion 28 constituting the preponderance of mass for use in toe end 26, reduced portion 38 and enlarged portion 28 connected by a leg 33.

For instance, in FIG. 4, the tail 29 of the "g" shape comprises the larger portion 28 which is generally rectangular with rounded corners 30, 60 at the end 31 of tail 29, a rear inner corner 39 and curve 40 at the juncture 32 with the leg 33 of the "g" shape. As upper surface 34 and lower surface 35 are parallel and flat, tail 29 has a greater volume than either leg 33 or body 36 and in fact, has a volume substantially equal to the sum of these parts 33, 36. Therefore, it is readily apparent that the mass of enlarged portion 28 is greater than the mass of either leg 33 or body 36.

Referring now to FIG. 5, hook shaped weighted mass 20 has enlarged portion 28 in the form of a hook with point 37 comprising rear inner corner 39 and curve 40 comprising the reverse curve of the hook. As in FIG. 4 and FIG. 6 hereafter, since surfaces 34 and 35 are parallel and flat, the volume of larger portion 28 is greater than reduced portion 38 or leg 33 and hence the mass of larger portion 28 is also greater than either portion 38 or leg 33.

Similarly, as best shown in FIG. 6, hatchet shaped weighted mass 20 has a scimitar shape as larger portion 28 with curve 40 comprising the blade of the scimitar joining corner 39 and juncture 32. Alternately, curve 40 may be a chord 46 joining juncture 32 and rear inner corner 39 as shown by the broken line in FIG. 6. It is readily apparent that the mass of enlarged portion 28 in each of FIGS. 4 through FIG. 6 is greater than the mass of either leg 33 or reduced end 38 and approximates the sum of these two parts.

Figure 7:
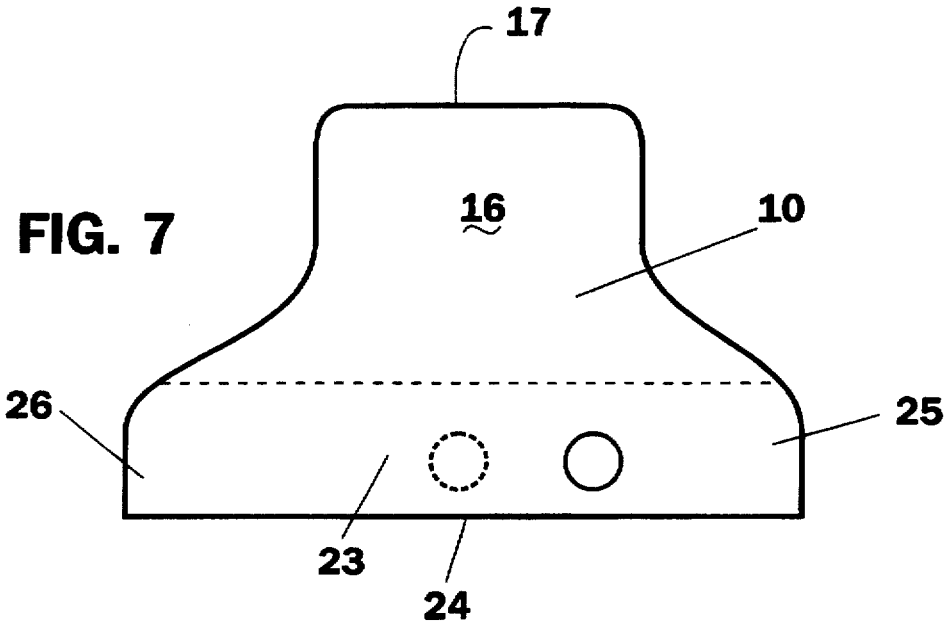
FIG. 7 is a top plan view of the preferred embodiment of a mallet type golf putter of this invention.

Referring now to FIG. 7, a mallet type putter head is shown. Mallet putters typically have an elongated shape along the putting line and hence have an elongated sole 43. Striking face 18 of each the four inch (4"), six inch (6") and mallet putters of this invention have the same frontal appearance as shown in FIG. 2 varying only in overall width.

Figure 8:
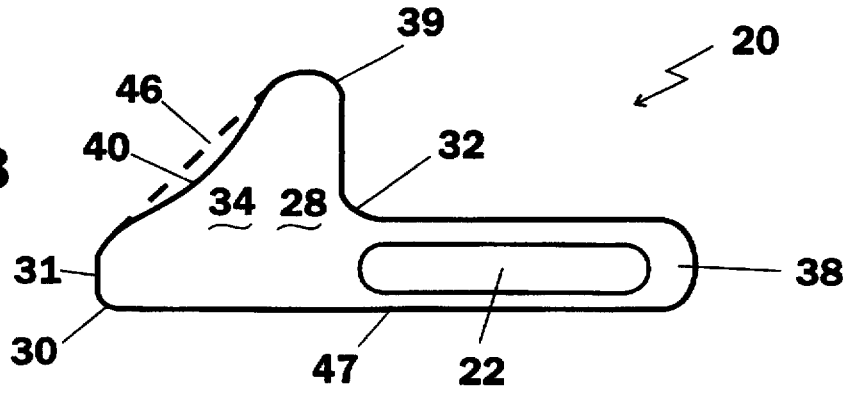
FIG. 8 is a top plan view of a weighted mass used in the mallet of FIG. 7.

In order to retain the bulk of weighted mass 20 in the end of a mallet putter, enlarged end 28 of FIG. 6 is essentially reversed as shown in FIG. 8, resulting in a truck body shape at end 31 having corner 60 comprises an elongated curve like curve 40 or chord 46 of FIG. 6. Although a flat plate with parallel sides 34, 35 is typically used in the mallet putter shown in FIG. 7, a plate of greater thickness through leg 33 and a leading portion of enlarged end 28 may be used where weighted mass 20 tapers toward rear inner corner 39. In the preferred embodiments, a flat plate is utilized for ease of manufacture however weighted mass 20 may be manufactured to approximate the shape of bottom surface 19 thereby facilitating the molding process by providing a substantially equal amount of polymeric composite between bottom surface 19 and lower surface 35 of weighted mass 20.

Weighted mass 20 shown in each of FIGS. 3–6 and FIG. 8 has needle like spikes 51 attached to the lower surface 35 thereof and extending to the bottom surface 19 of thermosetting polymeric head 14 thereby supporting weighted mass 20 above bottom surface 19. Spikes 51 may be affixed to lower surface 35 by any means known in the art but should be affixed to provide for equal support to weighted mass 20 such that weighted mass 20 is supported parallel to and spaced above bottom surface 19. Therefore, spikes 51 attached to leg 33 and adapted to be placed in central portion 23 over flat sole 43 will be longer than spikes 51 attached to either larger portion 28 or reduced portion 38 as these latter portions are supported above bottom surface 19 over toe taper 45 and heel taper 44 respectively. Needle like spikes 51 as shown in FIG. 3 are not readily visible on the exposed bottom surface 19 as the ends thereof are indistinguishable from the ground walnut shells incorporated in thermosetting polymeric head 14 as will be hereinafter described.

Thermosetting polymeric head 14 is comprised of an open molded thermosetting polymeric resin composite compounded from a resin selected from the group comprising epoxy, acrylic, vinyl ester, methyl methacrylate, isophthalic polyester, terephthalic polyester, orthophthalic polyester, dicyclopentadiene and polyurethane, these materials more commonly used as base resins for "gel" coatings used for coating the interior of sewer or water lines in an underground location without excavation of the line. Gel coats are also widely used in the manufacture of formed fiberglass items such as boats, tanks and containers.

Fillers such as wollastinite, mica, fiber glass, silica, talc, clay, carbon black, glass or ceramic microspheres, granulated or ground oak, maple, mahogany or walnut and colorants such as titanium dioxide, calcium carbonate, barium sulfate, lead or zinc chromates, iron oxide, magnesium silicate may be utilized to change the color or to reduce the cost of the compounded thermosetting polymeric resin composite. In addition, inhibitors to delay the effects of polymer aging such as hydroquinones, especially toluhydroquinone and 2–5,ditertiary butylhydroquinone may be used. Flow control agents and wetting agents selected from the silanes, siloxanes and silicones ensure mold filling and enhance adhesion to weighted mass 20. Viscosity is controlled by thixotropic index modifiers of fumed silica and surface treated clays. The polymeric compound is thermoset using accelerators and hardeners based on cobalt or sodium salts and tertiary amines. Peroxides may also be used to initiate polymerization.

It has been found that ground walnut shells are particularly suited for reducing the total cost of the compounded resin as well as change the color which produces a stone like look to head 14. It has also been found that diatomaceous silica and magnesium silicate approximates a bone look and that the use of ground oak approximates a pressed wood look. Other simulated looks may be produced by utilizing various other combinations of the above compounding materials without departing from the scope of this invention.

Compounding of polymeric materials for use in casting or molding of objects is well known in that art but it has been found that a suitable polymers for head 14 may be made from the formula:

| Compounding ingredient | Parts per hundred polymer by weight |
|---|---|
| Polymer resin | 100 |
| Filler | 30–100 |
| Colorant | 5–20 |
| Processing aid (inhibitors and flow control agents) | 0–15 |
| Thixotropic agent | 0–10 |
| Accelerators | 1–10 |
| Catalyst | 1–10 |

The particular amounts of each of the ingredients is selected to produce the physical properties of the compounded mass upon fixing in its final state as is well known in the art of compounding, the catalyst being added to the admixed base ingredients just prior to forming in the mold as will be hereinafter described in a method of making the putter head 14.

Weighted mass 20 typically is a flat plate of a shape selected from FIG. 4 through FIG. 6 or FIG. 8 of a specific thickness to produce a specific weight for each specific putter while maintaining the bulk of the weight in the toe end 26. Since the total weight of head 14 should be in the range of 290–310 grams for a four inch (4") blade putter and the weight of a molded head 14 without a weight encapsulated therein is approximately 145 grams, weighted mass 20 must be at least 145 grams. Weighted mass 20 is typically made from metallic materials such as brass, bronze, lead or steel but may be a polymeric matrix containing comminuted metallic particles of these materials therein. It is apparent therefore, that the thickness of weighted mass 20 is determined from the desired shape and material to achieve the desired weight. Since weighted mass 20 is a flat plate, the center of the thickness of the plate determines its vertical center of mass. In order to keep the golf ball from skipping across the surface of the putting green, the ball should be struck on its centerline with striking face 18 of head 14. Since the ball diameter is approximately 1.68 inches, striking face 18 will contact the ball at a height of no more than 0.83 inches above the putting surface. As a golfer does not usually scrub sole 43 on the putting surface but elevates head 14 up to one fourth inch (¼") thereabove, the center of mass of the weight should be no more than three quarters of an inch (¾) above the putting surface. Therefore, the center of mass of weighted mass 20 has been placed at or below the centerline of the ball to be struck and in particular has its center of mass approximately three eighths inch (⅜") above bottom surface 19 of flat sole 43. Since the overall thickness of head 14 need only be greater than the half the diameter of the ball in order to impact the ball on its centerline, head 14 is approximately one inch in height measured from flat sole 43 to top surface 16.

In the preferred embodiment of FIG. 1, a six inch (6") blade type golf putter 10 has a grip 12 at one end 13 of a shaft 11 and a head 14 at the opposite end 15, the head 14 further comprising an open molded compounded thermoset resin composite enclosing a "g" shaped weighted mass 20 of FIG. 4 therein. Head 14 has a heel end 25, spaced longitudinally approximately six inches (6") from a toe end 26, a top surface spaced vertically approximately one inch (1") from a bottom surface 19 at the flat sole portion 43 thereof and a substantially planar front striking face 18 spaced approximately one and one half inches (1½") from a rear surface 17. Front striking face 18 is generally normal to the putting surface and hence is generally perpendicular to flat sole 43. Additionally, bottom surface 19 usually comprises a toe taper 45 and a heel taper 44 of seven (7) to twelve (12) degrees as measured from flat sole 43. For the six inch (6") blade putter, a relief 48 is provided in top and rear surfaces 16, 17 to provide for the final overall weight of putter 10. Additionally, heel end 25 and toe end 26 may have truncated rear corners shown in FIG. 1. Toe taper 45, heel taper 44, flat sole 43 and the height between bottom surface 19 and top surface 16 as well as the depth from front striking face 18 to rear surface 17 are identical for a four inch (4") blade putter although no relief 48 is provided. Only the overall length of the blade is changed when constructing the shorter blade putter which is readily accomplished in the method of making the putter hereinafter described.

Weighted mass 20 completely enclosed and encapsulated in head 14 has an aperture 22 in the form of a slot which is greater in width than the diameter of end 15 of shaft 11 and is adapted for receiving the terminal end of shaft 11 therein. Aperture 22 extends from heel end 25 through to central portion 23 and is spaced approximately one quarter inch (¼") from front edge 24 such that shaft 11 may be placed at any position along aperture 22 as desired by the individual golfer. Shaft 11 is prepared according to means known in the art and is then fixedly attached to head 14 by suitable adhesives including epoxies. It is readily apparent that since epoxies may be utilized as thermosetting polymeric material, the colorants and fillers utilized in polymeric material may be utilized in the epoxy to affix shaft 11 to head 14. Shaft 11 may have a hosel (not shown) on end 15 thereof which is contiguous with top surface 16 of head 14 and affixed thereto in a similar manner.

In the preferred embodiment, "g" shaped weighted mass 20 shown in FIG. 2 encapsulated within head 14 has the tail of said "g" in toe end 26. The tail of the "g" comprises larger portion 28 of weighted mass 20 and hence contains a preponderance of the mass of weighted mass 20 therein. Leg 33 is narrow relative to larger portion 28 and reduced portion 38 is narrower in both width and length relative to larger portion 28, these narrower portions cooperating with larger portion 28 to widen the "sweet spot" on striking face 18. It is apparent that the striking force will be approximately equal across striking face 18 at any location therealong as larger portion 28 provides a counterbalance to the force provided by the golfer through shaft 11. In this manner, the "sweet spot" of striking face is substantially equal to the length of weighted mass 20.

In the preferred embodiment of a mallet putter 10 of this invention as shown in FIG. 7, rear surface 17 is spaced from striking face 18 by a greater distance than with the blade putter 10 of FIG. 1. For instance, the length of sole 43 along the putting line perpendicular to striking face 18 is approximately two and three quarters inches (2¾") and the plan view of the mallet assumes a liberty bell shape. In addition, the shape of weighted mass 20 more closely assumes the shape of a portion of the mallet putter as shown in FIG. 8. Since weighted mass has large curve 40 or chord 46 on end 31, the thickness of weighted mass 20 may be greater in larger portion 28 or the depth toward rear inner corner 39 may be increased to provide for a suitable weight for weighted mass 20. Reduced portion 38 is also reduced as shaft 11 is generally disposed more toward center portion 23 than with blade putters. Weighted mass 20 of FIG. 8 has aperture located along and spaced away from front edge 24 as with weighted mass 20 of FIG. 4 through FIG. 6. Top surface 16 of mallet putter 10 of FIG. 7 may also be tapered toward rear surface 17 to provide for the overall weight thereof A method of manufacturing a golf putter 10 comprises the steps of first forming an open mold cavity having the overall width between heel end 25 and toe end 26 and depth between top surface 16 and bottom surface 19 of a six inch (6") blade putter as shown in FIG. 2. The open mold cavity may be formed in any suitable material such as aluminum, steel, wood or thermoplastic and should have a length along flat sole 43 equal to the length from striking face 18 to rear surface 17 of a mallet putter 10 shown in FIG. 7. Suitable slots for dams are provided in the end of the mold cavity forming heel end 25, toe end 26 and rear surface 17 such that the different putters of this invention may be constructed using a single mold cavity. Toe taper 45 and heel taper 44 are formed in the bottom of the mold cavity completing the shape of bottom surface 19.

A weighted mass 20 is formed from a suitable material having a specific gravity significantly greater than the specific gravity of thermosetting polymeric resin composite to be used to form putter head 14. Weighted mass 20 may be formed from steel, brass, bronze, lead or comminuted particles of these metallic materials admixed into a polymeric matrix. Weighted mass 20 may be stamped, flame cut or laser cut from a flat plate or cast in a separate molding operation but is preferably stamped from a flat plate of steel. The shape of weighted mass 20 of FIG. 4 through FIG. 6 or FIG. 8 is established from the external shape of the particular putter head. Generally, weighted mass 20 for each of the various style putters is formed in pre-established weight ranges. Typically, weighted mass 20 for a four inch (4") blade putter will be formed in three weights such that the overall weight of head 14 may be approximately 290 grams, 300 grams and 310 grams for a light, medium and heavy putters, respectively. Similarly, a six inch (6") putter has three weights of approximately 320 grams, 330 grams and 340 grams and a mallet putter has three weights of approximately 380 grams, 390 grams and 400 grams respectively for the light, medium and heavy putters. Needle like spikes 51 are affixed to lower surface 35 of weighted mass 20 by welding, gluing or molding. Spikes 51 of different lengths are affixed to lower surface 35 according to the location of each particular spike 51 within the mold cavity. The longest spikes 51 are affixed in the flat sole portion 43 while shorter spikes 51 are affixed on heel taper 44 or toe taper 45. Weighted mass 20 is place in and supported above the bottom of the mold cavity by spikes 51 such that weighted mass 20 is completely enclosed and encapsulated within head 14 when the molding step is completed.

The thermosetting polymeric resin composite is compounded to include at least a colorant and an accelerator. The general formula above provides for a wide range of thermosetting polymers according to the desires of the club maker. All the ingredients except the catalyst in their respective quantities are loaded into a reactor vessel having a stirring mechanism disposed therewithin. The reactor vessel is closed and the mixture stirred until the ingredients are properly admixed. The vessel is then subjected to a vacuum of at least 26 inches of mercury to remove any entrapped air from the mixture. One inlet of a proportioning pump is then attached to a bottom port in the reactor vessel and the other inlet port to a container having a catalyst contained therein. The proportioning pump is switched on and the mold cavity is filled with sufficient thermosetting polymer composite to completely fill the mold cavity and establish top surface 16. The catalyst is admixed with the thermosetting polymer composite in the proportioning pump and the mold filling lines such that additional mixing in the mold cavity is unnecessary.

Most thermosetting polymeric resin composites utilized in making the putter head 14 of this invention are exothermic during the curing stage giving up heat from the compounded polymer. Some require a post cure at an elevated temperature to develop the full physical properties desired for a molded head. The hardness of a polymeric putter head 14 shall be at least 70 points Shore D and typically is about 90 points Shore D.

When molding a six inch (6") putter head 14, a dam is placed in the mold cavity at a distance of one and one half inches from the wall of the mold cavity forming striking face 18. No other dams are used to make this larger putter head 14. In order to manufacture a mallet putter, no dam is used parallel to striking face 18 but a dam is placed parallel to and spaced approximately three quarters of an inch (¾") from each end of the mold cavity. Finally, to manufacture a four inch (4") putter head 14, a dam is placed parallel to and spaced approximately three quarters of an inch (¾") from each end of the mold cavity and a dam is placed in the mold cavity at a distance of one and one half inches from the wall of the mold cavity forming striking face 18. Similarly, other putter head shapes may be molded in the mold cavity by utilizing dams in the proper locations and of the proper shape to mold a head 14 of the desired shape.

After the molding step and curing step are complete, the finished putter head 14 is removed from the mold cavity by inverting the mold and tapping lightly upon the outer bottom surface to dislodge the putter head 14 from the cavity. Each of the surfaces 16, 17, 18, 19, 44 and 45 of the finished putter head 14 may be machined but typically only the striking face 18 and the top surface 16 are machined flat. When a six inch (6") head 14 is manufactured, relief 48 is typically cut into rear surface 17 and top surface 16 to remove some of the mass of the polymeric head to establish the exact overall weight of the head 14. Additionally, the top surface 16 of a mallet putter head 14 of FIG. 7 may be tapered toward rear surface 17. After the machining step, a hole for shaft 11 is formed into top surface 16 extending through aperture 22 in weighted mass 20 but terminating above bottom surface 19. The hole for shaft 11 is formed by drilling a hole perpendicular to top surface 16 just slightly greater than the diameter of the finished end of the shaft 11. End 15 of shaft 11 has been prepared by removing any residual paint, oils or other foreign matter from approximately one inch (1") of the terminal end. An epoxy or other suitable adhesive is prepared and injected in to the hole drilled in top surface 16. End 15 of shaft 11 is then inserted into the hole and rotated into proper orientation for the golfer. Excess adhesive is removed from around end 15 of shaft 11 and the adhesive is allowed to cure or set with flat sole 43 resting upon a flat surface and shaft 11 projecting upwardly. When a hosel is desired to be affixed to end 15 of shaft 11, adhesive is applied to a greater length of shaft 11 and the hosel is placed upon shaft 11 just prior to inserting shaft 11 into the hole in top surface 16. Finally, shaft 11 is cut to length and grip 12 is firmly affixed to end 13 of shaft 11 in a manner well known in the art.

While the forms and methods of this invention now preferred have been illustrated and described as required by the Patent Statute, it is to be understood that other forms and methods can be utilized and still fall within the scope of the appended claims.

I claim:

1. A golf putter having a shaft with a grip at one end and a head at the opposite end, said head having a heel end, a toe end spaced longitudinally from said heel end, a top surface, a rear surface, a bottom surface and a substantially planar front striking face, said head comprising a open molded compounded thermoset polymeric resin composite having a weighted mass fully enclosed therein, the terminal end of said shaft residing in an aperture in said mass and said shaft fixedly attached to said head, said weighted mass (has) having needle like projections extending to said bottom surface of said thermoset polymeric head supporting said weighted mass above said bottom surface.

2. A golf putter as in claim 1 wherein said open molded thermoset polymeric resin composite is compounded from a resin selected from the group consisting of epoxy, acrylic, vinyl ester, methylmethacrylate, isophthalic polyester, terephthalic polyester, orthophthalic polyester, dicyclopentadiene and urethane.

3. A golf putter as in claim 2 wherein said thermosetting polymeric resin has ground walnut shells incorporated therein approximating a stone like look to said head.

4. A golf putter having a shaft with a grip at one end and a head at the opposite end, said head having a heel end, a toe end spaced longitudinally from said heel end, a top surface, a rear surface, a bottom surface and a substantially planar front face, said head comprising a open molded compounded thermosetting polymeric resin composite having a weighted mass fully enclosed therein, said weighted mass having an aperture therein extending from said heel end to a central portion between said heel end and said toe end and parallel to and spaced from a front edge of said weighted mass, said aperture receiving the terminal end of said shaft therein, said shaft is fixedly attached to said head.

5. A golf putter as in claim 4 wherein said head has a preponderance of said weighted mass at the toe end thereof.

6. A golf putter as in claim 4 wherein said head has said shaft affixed to a central portion between said heel end and said toe end.

7. A golf putter as in claim 4 wherein said head has said shaft affixed to said heel end.

8. A golf putter as in claim 4 wherein said the center of mass of said weighted mass is located above said base no more than one half of the diameter of the ball to be struck.

9. A golf putter as in claim 8 wherein said the center of mass of said weighted mass is captured in said thermoset polymeric head at approximately three eighths inch (⅜") above said bottom surface.

10. A golf putter having a shaft with a grip at one end and a head at the opposite end, said head having a heel end, a toe end spaced longitudinally from said heel end, a top surface, a rear surface, a bottom surface and a substantially planar front face, said head comprising a open molded compounded thermoset resin composite enclosing a "g" shaped weighted mass therein said weighted mass having an aperture therein for receiving the terminal end of said shaft therein and wherein said shaft is fixedly attached to said head, said aperture in said "g" shaped weighted mass extending from said heel end to a central portion between said heel end and said toe end, a portion of said aperture lying parallel to and spaced from a front edge of said weighted mass.

11. A golf putter as in claim 10 wherein said head has said shaft affixed to a central portion between said heel end and said toe end.

12. A golf putter as in claim 10 wherein said head has said shaft affixed to said heel end.

13. A golf putter as in claim 10 wherein said open molded thermoset polymeric resin composite is compounded from a resin selected from the group consisting of epoxy, acrylic, vinyl ester, methylmethacrylate, isophthalic polyester, terephthalic polyester, orthophthalic polyester, dicyclopentadiene and urethane.

14. A golf putter as in claim 1 wherein said head has a preponderance of said weighted mass at the toe end thereof.

15. A golf putter as in claim 1 wherein said head has said shaft affixed to said heel end.

16. A golf putter as in claim 1 wherein said shaft has said shaft affixed to a central portion between said heel end and said toe end.

17. A golf putter as in claim 10 wherein said the center of mass of said weighted mass is located above said base no more than one half of the diameter of the ball to be struck.

18. A golf putter as in claim 17 wherein said the center of mass of said weighted mass is captured in said thermoset polymeric head at approximately three eighths inch (⅜") above said bottom surface.

19. A golf putter as in claim 1 wherein said the center of mass of said weighted mass is located above said base no more than one half of the diameter of the ball to be struck.

20. A golf putter as in claim 19 wherein said the center of mass of said weighted mass is captured in said thermoset polymeric head at approximately three eighths inch (⅜") above said bottom surface.

* * * * *